United States Patent [19]

Dove

[11] 3,945,570

[45] Mar. 23, 1976

[54] STEAM SUPPLY APPARATUS

[75] Inventor: Norman F. Dove, Cranbrook, Canada

[73] Assignee: Devron Engineering Ltd., Vancouver, Canada

[22] Filed: Dec. 10, 1974

[21] Appl. No.: 531,388

[52] U.S. Cl. ..... 239/135; 239/139

[51] Int. Cl.[2] ..... B05B 1/24; B44D 3/42

[58] Field of Search ..... 239/135, 136, 137, 139; 34/155, 160; 162/207, 290; 137/561, 608

[56] References Cited

UNITED STATES PATENTS

| | | | |
|---|---|---|---|
| 1,529,562 | 3/1925 | Vezie | 239/139 |
| 2,602;877 | 7/1952 | Dawson | 239/135 |
| 3,386,659 | 6/1968 | Rea | 239/135 |
| 3,857,514 | 12/1974 | Clifton | 239/139 |

*Primary Examiner*—Lloyd L. King

*Attorney, Agent, or Firm*—Larson, Taylor and Hinds

[57] ABSTRACT

A steam supply apparatus. At least a first and second pipe are located in spaced apart, side by side relationship. A cover member extends longitudinally between the pipes and is secured to them. A bottom wall is spaced below the cover member and extends longitudinally of the pipes and is secured to them. The pipes, cover member and bottom wall form between them a steam chamber. End members close the steam chamber near opposite ends of the pipes. There are steam outlet means in the bottom wall that extend substantially the length of the chamber between the pipes. There are means for supplying steam to the pipes. Each pipe has a plurality of apertures arranged longitudinally of the pipe to maintain the interior of the steam pipes in communication with the steam chamber. The pipes are adapted to extend across a surface against which steam is to be directed through the outlet means and to support the steam chamber above the surface.

12 Claims, 5 Drawing Figures

STEAM SUPPLY APPARATUS

BACKGROUND OF THE INVENTION

1. Field of the Invention

Figure 1:
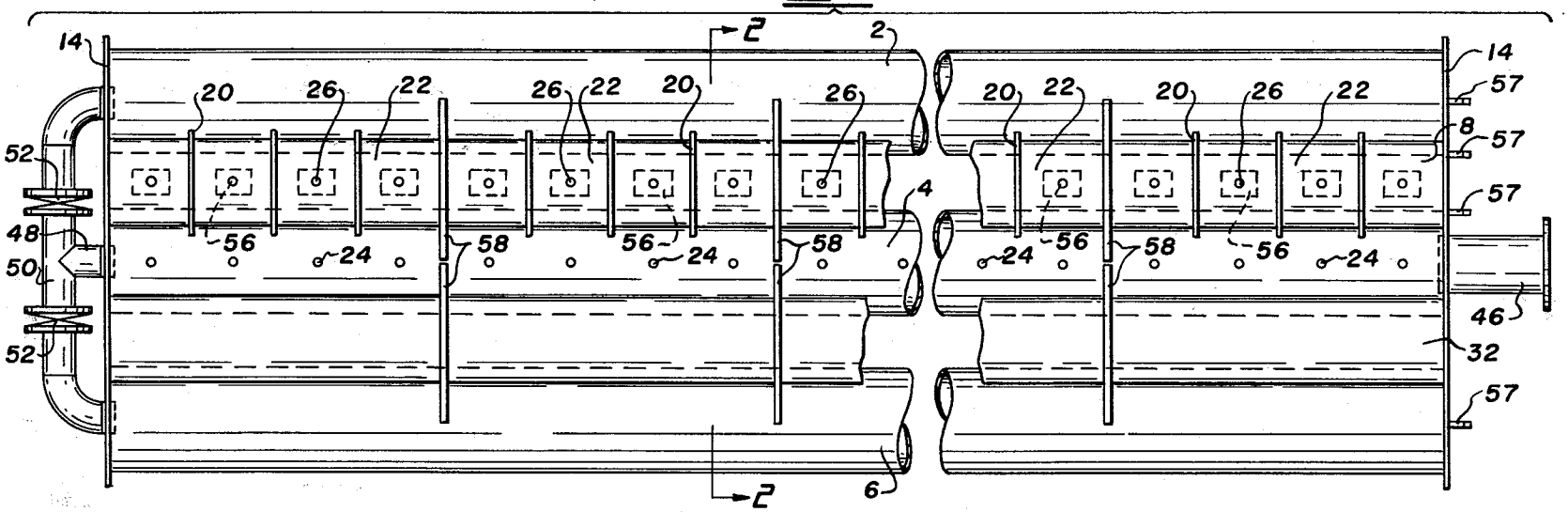

This invention relates to a steam supply apparatus.

2. Description of the Prior Art

It is frequently desired to apply steam in industrial processes. A particular example of such a process is the paper-making process. It is well established that the application of steam to the Fourdrinier section of a paper-making machine aids the removal of water from the pulp on the section. The steam is normally applied immediately above the suction box and is forced through the pulp by the suction boxes. The use of steam aids the drainage of water from the pulp by eliminating air from the sheet and by raising the temperature. The raising of the temperature lowers the viscosity and surface tension of the water and thus facilitates its removal.

SUMMARY OF THE INVENTION

The present invention provides a steam supply apparatus comprising at least a first and a second pipe located in spaced apart, side by side relationship, a cover member extending between the pipes and extending longitudinally thereof and secured thereto, a bottom wall spaced below said cover member and extending longitudinally of and between and secured to the pipes, said pipes, cover member and bottom wall forming a steam chamber therebetween, end members closing said steam chamber near opposite ends of the pipes, steam outlet means in the bottom wall and extending substantially the length of the chamber between the pipes, and means for supplying steam to the pipes, each pipe having a plurality of apertures therein arranged longitudinally thereof and maintaining the interior of said steam pipe in communication with the steam chamber, and said pipes being adapted to extend across a surface against which steam is to be directed through said outlet means and to support the steam chamber above said surface.

In a preferred embodiment the invention is a steam supply apparatus comprising first, second and third pipes located in spaced apart, side by side relationship, the second pipe between the first and third; upper and lower extending in spaced relationship between the first and second pipes to define a first steam chamber; end walls closing the first steam chamber near the ends of the first and second pipes; steam outlet means in the lower wall of the first steam chamber substantially the length of the chamber between the pipes; apertures arranged longitudinally in the first and second pipes whereby steam can be fed from each pipe into the first steam chamber; baffles dividing the first steam chamber into a plurality of compartments; openings in the upper surface of the second pipe and of the upper surface of the steam chamber, at least one opening to one compartment, the openings being in pairs, one opening of each pair in the second pipe, one in the steam chamber; conduits joining each pair of openings; a valve in each conduit; upper and lower walls extending in spaced relationship between the second and third pipes to define a second steam chamber; end walls closing the second steam chamber near the ends of the second and third pipes; steam outlet means in the lower walls of the second steam chamber substantially the length of the chamber between the second and third pipes; apertures arranged longitudinally in the second and third pipes whereby steam can be fed from each pipe into the second steam chamber; means to supply steam to the first, second and third pipe; said pipes being adapted to extend across the surface against which steam can be directed through the apertures in the bottom walls of the first and second steam chambers and support the first and second steam chambers above the surface.

The above steam outlet means in the lower wall may comprise slots arranged longitudinally of the steam chamber. The slots are preferably in a plurality of rows and slots in each row are staggered relative to the slots in the neighboring row. In this embodiment the lower wall or walls are preferably curved.

In a further desired embodiment, steam outlet means in the lower wall or walls comprise a plurality of holes along the length of the wall or walls. There is a further wall arranged above and spaced from the lower wall and extending between the pipes. The further wall is also provided with a plurality of holes along its length.

In use, the steam supply apparatus is positioned so that the pipes extend transversely in the direction of motion of the Fourdrinier web. Steam supplied to the steam pipe passes through the apertures into the spaces between the pipes, out from the steam chamber to the steam outlet means onto the pulp sheet. Condensation of steam within the apparatus drains to the bottom of the pipe from whence it can be drained by apertures and drain tubes.

The steam pipes form a main, intregal part of the steam supply apparatus. This reduces the bulk of the apparatus as compared with the prior art. Stiffeners may be secured at intervals between the pipes to ensure that the apparatus is proficiently rigid.

Desirably the apparatus is provided with a jacket in spaced relationship to the cover member. Insulating material may be located in the space between the jacket and the cover. It is preferable if the jacket extends over the outer sides of the outer pipe.

In the embodiment of the invention in which there are openings in the upper surface of the second pipe and of the upper surface of the first steam chamber with valved conduits joining pairs of openings it is possible to vary the amount of steam supplied at various points across the web of the Fourdrinier. Furthermore, this embodiment permits a control of the steam applied initially to the web. The amount of steam supplied can be increased by opening the valves completely when a relatively large amount of steam will pass through the first steam chamber.

Figure 3:
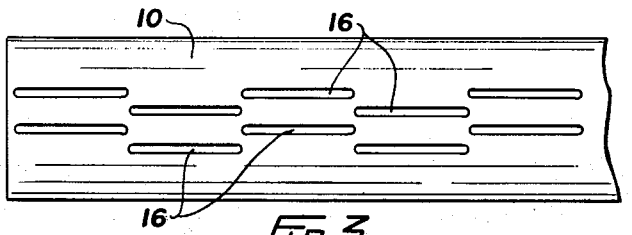
Figure 2:
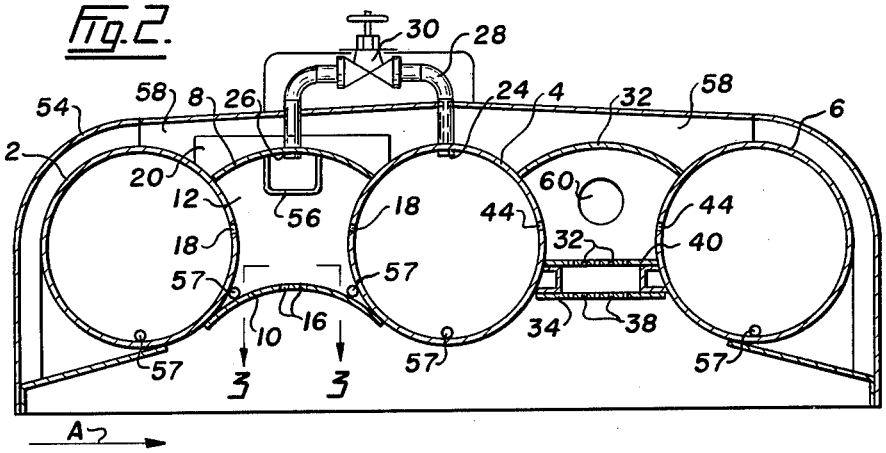
Figure 4:
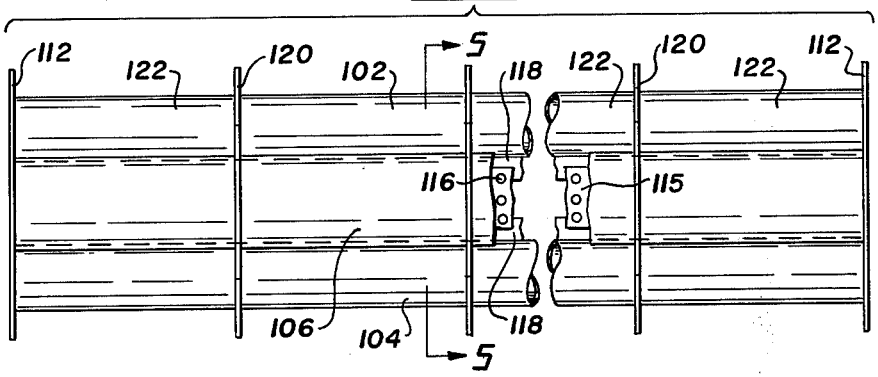
Figure 5:
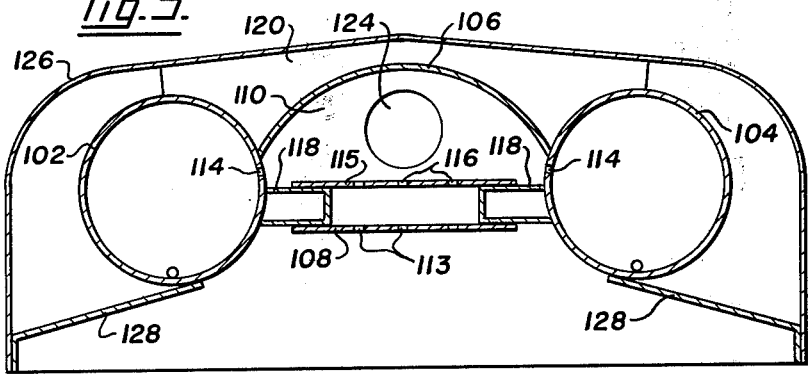

This invention is illustrated, by way of example, in the drawings in which:

FIG. 1 is a plan, partly broken away, of a preferred embodiment of the present invention, FIG. 2 is a section along the line 2—2 in FIG. 1, FIG. 3 is a segment of a section taken on the line 3—3 in FIG. 2, FIG. 4 is a plan, partly broken, of a further embodiment according to the present invention, and FIG. 5 is a section along the line 5—5 in FIG. 4.

FIGS. 1 to 3 show a steam supply apparatus comprising a first pipe 2, a second pipe 4 and a third pipe 6 located in spaced apart, side by side relationship.

An upper wall 8 and a lower wall 10 extend between the first pipe 2 and the second pipe 4 to define a first steam chamber 12. End walls 14 close the first steam chamber 12 near the ends of the first pipe 2 and the second pipe 4 as best illustrated in FIG. 1. There are steam outlet means 16 in the lower wall 10 of the steam chamber 12. These steam outlet means run substantially the length of the chamber 12. As illustrated in FIG. 3 the outlets 16 are slots arranged in a plurality of rows. A typical slot may measure, for example, 6 inch by 3/16 inch. The slots 16 in any one row are staggered relative to the slots 16 in the neighboring row. In the embodiment illustrated in FIGS. 1 to 3 the lower wall 10 is curved.

There are apertures 18 arranged longitudinally in the first pipe 2 and the second pipe 4. These apertures permit the feeding of steam from the pipes 2 and 4 into the first steam chamber 12. These apertures are located above the horizontal diameter of the pipes 2 and 4 to reduce the possibility of condensate passing from the pipes 2 and 4 into the chamber 12. Baffles 20 divide the steam chamber 12 into a plurality of compartments 22. There are openings 24 in the upper surface of the second pipe 4 and openings 26 in the upper surface of the first steam chamber 12. There is at least one opening 26 to each compartment 22. The openings 24 and 26 are arranged in pairs, one opening 24 of each pair 24 and 26 in the second pipe 4 and one opening 26 of each pair 24 and 26 in the chamber 12. As shown in FIG. 2 there are conduits 28 joining each pair of openings 24 and 26. For clarity these conduits are not shown in FIG. 1. Each conduit 28 has a valve 30 to enable control of the steam flow through the conduit.

An upper wall 32 and a lower wall 34 extend in spaced relationship between the second pipe 4 and the third pipe 6. Between them the walls 32 and 34 define a second steam chamber 36. The end walls 14 also close off the second steam chamber 36 near the ends of the second pipe 4 and the third pipe 6. There are steam outlet means 38 in the lower wall 34 of the second steam chamber 36. These outlets 38 run substantially the length of the steam chamber 36. The steam outlet means 38 comprise a plurality of holes arranged in a pattern. There is a further wall 40 arranged above and spaced from the lower wall 34, also extending between the pipes 4 and 6. The wall 40 is also provided with a plurality of holes 32 along its length. There are apertures 44 arranged longitudinally in the second pipe 4 and the third pipe 6 whereby steam can be fed from pipes 4 and 6 into the second steam chamber 36. Again, to reduce the possibility of condensate passing from the pipes 4 and 6 into the steam chamber 36, apertures 44 are arranged above the horizontal axis of the pipes 4 and 6.

The main inlet pipe 46, shown in FIG. 1, feeds steam into the second, central steam pipe 4. At the other end of the steam pipe 4, a pipe 48 directs the steam into a manifold 50 from which steam can be fed into first pipe 2 and second pipe 4. There are valves 52 in the manifold 50 to control the distribution of steam in and to the pipes 2, 4 and 6.

The illustrated apparatus is provided with an insulation cover 54 although, for clarity, this has been removed in FIG. 1. This cover 54 extends downwardly alongside pipes 2 and 6.

Each compartment 22 in the first steam chamber 12 is provided with a steam distributor 56 which facilitates the even distribution of steam throughout each section 22. Condensate can be removed through pipes 57.

To maintain adequate rigidity, the apparatus is provided with stiffeners 58 extending across the steam chambers 12 and 36 and around the pipes 2, 4 and 6.

Where necessary the stiffeners 58 are provided with openings 60 to permit communication between the sections of the chamber 12 or the chamber 36 upon each side of the stiffeners 58. Generally speaking, in the embodiment illustrated in FIGS. 1 to 3, such openings 60 will not be desirable in the first steam chamber 12 as it is not desired that the sections 22 should communicate with each other. Instead it is desired that the sections 22 be, at least in part, controllably communicable with the first pipe 2 so that the amount of steam fed from each section 22 can vary, depending upon the adjustment of the plurality of valves 30 in the conduits 28.

It should be emphasized that the apparatus in FIGS. 1 to 3 may be varied in one particularly important respect. That is the lower walls 10 and 34 of the steam chambers 12 and 36 can be interchanged. In this matter each steam chamber 12 and 36 has a lower wall as illustrated in FIG. 2 for chamber 12. Alternatively each chamber 12 and 36 can have a lower floor 34, with a spaced wall 42 as illustrated in FIG. 2 for chamber 36. Of course the illustrated embodiment is also useful. However, the two lower walls could be interchanged. That is chamber 12 could have the lower wall 34 with spaced wall 40 and the chamber 36 could have the lower wall 10. In general the lower wall 10 permits the feeding of high velocity steam. The lower wall 34 in combination with the spaced wall 42 diffuses a blanket of low velocity steam but gives a good uniformity of the steam across a large cross-sectional area.

The lower wall 10 is formed by cutting slots 16 in a single plate in the pattern as illustrated in FIG. 3. The plate is then rolled to a given radius, as illustrated in FIG. 2, then welded to the pipes 2 and 4. If the plate shifts during operation the slots will also shift but they will maintain their relative width. A disadvantage of pior art machines is their distortion upon heating. This feature is not as prevalent in the embodiment of the present invention illustrated in FIGS. 2 to 4 and, as indicated above, if distortion occurs its undesirable effects are reduced to a minimum. Lower wall 34 and spaced wall 40 have the same advantage, the open area of these walls is maintained under all conditions. This ensures uniform steam output.

The apparatus illustrated in FIGS. 1 to 3 is adapted to extend across a surface against which steam can be directed through the apertures 16 and 38. The preferred direction of movement on the surface is illustrated by the arrow A in FIG. 2.

A further embodiment of a steam supply apparatus according to the present invention is illustrated in FIGS. 4 and 5. In these figures the illustrated steam supply apparatus comprises a first pipe 102 and a second pipe 104 spaced apart from the first pipe. A cover member 106 extends between the pipes 102 and 104 and is secured to the pipes. A bottom wall 108 is spaced below the cover member 106 and extends longitudinally of and between the pipes 102 and 104. The pipes 102 and 104, the cover member 106 and the bottom wall 108 form a steam chamber 110 between end members 112 to close the steam chamber 110 near opposite ends of the pipes 102 and 104. These end members 112 are best shown FIG. 4. There are steam outlet means in the bottom wall 108 in the form of a plurality of holes 112 along the length of the bottom wall. A plurality of apertures are arranged in each pipe longitudinally. These apertures 114 maintain the interior of the steam pipes 102 and 104 in communication with the steam chamber 110. The apertures 114 are arranged above the horizontal diameter pipes 102 and 104 to reduce the possibility of condensate passing through the apertures 114 into the steam chamber 110. Like the apparatus illustrated in FIG. 1 to 3 the apparatus of FIGS. 4 and 5 have means for feeding steam to the pipes 102 and 104 although these are not shown in the plan view FIG. 4. Steam supply means will comprise an inlet pipe connected to one end of one of the pipes 102 and 104. At the end opposite the inlet pipe a connector pipe joins the pipes 102 and 104. Thus steam can be fed into one of the pipes through the inlet pipe and distributed to the other pipes through the connector pipe.

A further wall 115 is arranged above and spaced from the lower wall 108. This further wall 115 is provided with a plurality of holes 116 along its length. Walls 108 and 115 are located by attachment to projecting portions 118, one portion 118 projecting from each of the pipes 102 and 104.

The apparatus in FIGS. 4 and 5 includes stiffeners 120 extending across the steam chamber 110 and secured to the pipes 102 and 104, and the cover member 106. Stiffeners 120 are spaced apart as shown in FIG. 4 and divide the chamber 110 into a series of sections 122. Where necessary, the stiffeners 120 are provided with apertures 124 that permit communication between adjacent sections 122.

The apparatus of FIGS. 4 and 5 is provided with an insulation cover 126. Flaps 128 extend from the cover 126 to the lower part of the pipes 102 and 104. The insulation cover 126, the flaps 128 and the exterior of the pipes 102 and 104 and of the central wall 106 define a chamber which can be packed with an insulating material.

All embodiments of the present invention are desirably provided with support brackets, which will vary depending upon where the apparatus is to be installed. Such brackets are normally equipped with four corner levelling bolts and an anchoring arrangement. The apparatus is anchored at the steam inlet end, the other end is free to expand. The support brackets are not illustrated in the drawings because of the wide variation depending upon the installation conditions.

Lifting eyes are desirably located at the upper corners of the unit, above the insulation covers. Typically one and one quarter inch diameter lifting eyes have proved useful. The apparatus is desirably made of stainless steel, Type 304 stainless steel has been used. A typical embodiment of the invention measures 60 inches wide, 125 inches long and about 24 inches high.

A 1½ inch thick fibreglass insulation rated for 400°F service has proved useful as an indicator. Suitable slip type expansion joints can be formed integral with the insulation jacket to compensate for differences in thermal expansion between the jacket and the main structure.

In use steam is fed into the main inlet pipe of the illustrated apparatus. The steam passes into pipe 4 in FIGS. 1 to 3 and is distributed to pipes 2 and 6 through the manifold 50. The apparatus of FIGS. 4 and 5 have analogous equipment. Steam passes through the apertures in the pipes into the steam chamber or chambers. From the steam chamber or chambers the steam is drawn through the Fourdrinier web. The amount of steam fed to each pipe 4 and 6 can be controlled by valves 52. The amount of steam fed across the web can be controlled by valves 30 in FIGS. 1 to 3. Opening a valve 30 increases the flow to the associated compartment 22.

I claim:

1. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; stiffeners extending across the steam chamber and secured to the pipes, the cover member and the bottom wall, said stiffeners being spaced apart and dividing the chamber into sections; openings in the upper surface of the second pipe and in the cover member, above the steam chamber, at least one opening to each section, the openings being in pairs, one opening of a pair in the second pipe, one in the steam chamber; conduits joining each pair of openings; and a valve in each conduit.

2. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; a third pipe spaced laterally from an adjacent end of said second pipe; a second cover member and a second bottom wall spaced from each other and secured to and extending longitudinally of said third pipe and said second pipe and forming a second steam chamber therebetween; end members closing said second chamber near opposite ends of the pipes; steam outlet means in said second bottom wall and extending substantially the length of the second chamber; means for supplying steam to the third pipe; said adjacent pipes and said third pipe having a plurality of apertures therein arranged longitudinally thereof and maintaining the interiors of said adjacent and third pipes in communication with the second steam chamber; said adjacent and third pipes being adapted to support the second steam chamber above said surface; baffles dividing the first steam chamber into a plurality of sections; openings in the upper surface of the second pipe and of the first steam chamber, at least one opening to each section, the openings being in pairs, one opening of a pair in the second pipe, one in the steam chamber; conduits joining each pair of openings; and a valve in each conduit.

3. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; and an insulation cover disposed over the pipes and extending downwardly alongside each pipe.

4. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; a third pipe spaced laterally from an adjacent end of said second pipe; a second cover member and a second bottom wall spaced from each other and secured to and extending longitudinally of said third pipe and said second pipe and forming a second steam chamber therebetween; end members closing said second chamber near opposite ends of the pipes; steam outlet means in said second bottom wall and extending substantially the length of the second chamber; means for supplying steam to the third pipe; said adjacent pipes and said third pipe having a plurality of apertures therein arranged longitudinally thereof and maintaining the interiors of said adjacent and third pipes in communication with the second steam chamber; said adjacent and third pipes being adapted to support the second steam chamber above said surface; and an insulation cover disposed over the pipes and extending downwardly alongside the first and third pipes.

5. Apparatus according to claim 1 in which there is a steam distributor positioned beneath each aperture in the first steam chamber whereby steam fed into each section of the chamber may be distributed evenly throughout the section.

6. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; the steam outlet means in said second bottom wall comprising slots arranged longitudinally of the bottom wall, the slots being in a plurality of rows, each slot in each row being staggered relative to the slots in the neighboring row.

7. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; a third pipe spaced laterally from an adjacent end of said second pipe; a second cover member and a second bottom wall spaced from each other and secured to and extending longitudinally of said third pipe and said second pipe and forming a second steam chamber therebetween; end members closing said second chamber near opposite ends of the pipes; steam outlet means in said second bottom wall and extending substantially the length of the second chamber; means for supplying steam to the third pipe; said adjacent pipes and said third pipe having a plurality of apertures therein arranged longitudinally thereof and maintaining the interiors of said adjacent and third pipes in communication with the second steam chamber; said adjacent and third pipes being adapted to support the second steam chamber above said surface; and in at least one of the first and second steam chambers, the steam outlet means in the lower wall comprising slots arranged longitudinally of the chamber, the slots being in a plurality of rows, slots in each row being staggered relative to the slots in the neighboring row.

8. Apparatus according to claim 7 in which the lower walls are curved.

9. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; the steam outlet means in the bottom wall comprising a plurality of holes along the length of the bottom wall; and a further wall arranged above and spaced from the lower wall and extending between the pipes, the further wall also being provided with a plurality of holes along its length.

10. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the interior of said steam pipe in communication with the steam chamber; said pipes being adapted to extend across a surface against which steam is to be directed through said outlet means and to support the steam chamber above said surface; a third pipe spaced laterally from an adjacent end of said second pipe; a second cover member and a second bottom wall spaced from each other and secured to and extending longitudinally of said third pipe and said second pipe and forming a second steam chamber therebetween; end members closing said second chamber near opposite ends of the pipes; steam outlet means in said second bottom wall and extending substantially the length of the second chamber; means for supplying steam to the third pipe; said adjacent pipes and said third pipe having a plurality of apertures therein arranged longitudinally thereof and maintaining the interiors of said adjacent and third pipes in communication with the second steam chamber; said adjacent and third pipes being adapted to support the second steam chamber above said surface; in at least one of the lower walls of the first and second steam chambers, the steam outlet means comprising a plurality of holes along the length of the wall; and a further wall arranged above and spaced from the lower wall and extending between the second and third pipes, the further wall also being provided with a plurality of holes along its length.

11. Steam supply apparatus comprising at least a first and a second pipe located in spaced apart, side by side relationship; a cover member extending between the pipes and extending longitudinally thereof and secured thereto; a bottom wall spaced below said cover member and extending longitudinally of and between and secured to the pipes; said pipes, cover member and bottom wall forming a steam chamber therebetween; end members closing said steam chamber near opposite ends of the pipes; steam outlet means in the bottom wall and extending substantially the length of the chamber between the pipes; means for supplying steam to the pipes; each pipe having a plurality of apertures therein arranged longitudinally thereof and maintaining the intrior of said steam pipe in communication with the steam chamber; said pipes being adapted to extend across a surface against which steam is to be directed through said outlet means and to support the steam chamber above said surface; a third pipe spaced laterally from an adjacent end of said second pipe; a second cover member and a second bottom wall spaced from each other and secured to and extending longitudinally of said third pipe and said second pipe and forming a second steam chamber therebetween; end members closing said second chamber near opposite ends of the pipes; steam outlet means in said second bottom wall and extending substantially the length of the second chamber; means for supplying steam to the third pipe; said adjacent pipes and said third pipe having a plurality of apertures therein arranged longitudinally thereof and maintaining the interiors of said adjacent and third pipes in communication with the second steam chamber; said adjacent and third pipes being adapted to support the second steam chamber above said surface; the steam outlet means in one lower wall comprising slots arranged in lines along the chamber, the slots being in a plurality of rows and the slots in each row being staggered relative to slots in each neighboring row; and the steam outlet means in the other bottom wall comprising a plurality of holes along the length of said bottom wall, there being a further wall arranged above and spaced from the lower wall and extending between the adjacent pipes, the further wall also being provided with a plurality of holes along its length.

12. Steam supply apparatus comprising:

first, second and third pipes located in spaced apart side by side relationship, the second pipe between the first and third;

upper and lower walls extending in spaced relationship between the first and second pipes to define a first steam chamber;

end walls closing the first steam chamber near the ends of the first and second pipes;

steam outlet means in the lower wall of the first steam chamber substantially the length of the chamber between the pipes;

apertures arranged longitudinally in the first and second pipes whereby steam can be fed from each pipe into the first steam chamber;

baffles dividing the first steam chamber into a plurality of compartments;

openings in the upper surface of the second pipe and of the upper surface of the first steam chamber, at least one opening to one compartment, the openings being in pairs, one opening of each pair in the second pipe, one in the steam chamber;

conduits joining each pair of openings;

a valve in each conduit;

upper and lower walls extending in spaced relationship between the second and third pipes to define a second steam chamber;

end walls closing the second steam chamber near the ends of the second and third pipes;

steam outlet means in the lower walls of the second steam chamber substantially the length of the chamber between the second and third pipes;

apertures arranged longitudinally in the second and third pipes whereby steam can be fed from each pipe into the second steam chamber;

means to supply steam to the first, second and third pipe;

said pipes being adapted to extend across the surface against which steam can be directed through the apertures in the bottom walls of the first and second steam chambers and support the first and second steam chambers above the surface.

* * * * *